US010633890B2

(12) United States Patent
Fellner et al.

(10) Patent No.: US 10,633,890 B2
(45) Date of Patent: Apr. 28, 2020

(54) DEVICE FOR MOVING A MOVABLE FURNITURE PART, AND ITEM OF FURNITURE

(71) Applicant: Grass GmbH, Hoechst (AT)

(72) Inventors: Tino Fellner, Hard (AT); Filip Rihtarec, Fussach (AT)

(73) Assignee: Grass GmbH, Hoechst (AT)

( * ) Notice: Subject to any disclaimer, the term of this patent is extended or adjusted under 35 U.S.C. 154(b) by 676 days.

(21) Appl. No.: 15/237,989

(22) Filed: Aug. 16, 2016

(65) Prior Publication Data

US 2017/0049231 A1 Feb. 23, 2017

(30) Foreign Application Priority Data

Aug. 21, 2015 (DE) ..... 20 2015 104 432 U

(51) Int. Cl.
*E05B 65/44* (2006.01)
*E05B 65/46* (2017.01)
(Continued)

(52) U.S. Cl.
CPC ..... *E05B 65/44* (2013.01); *A47B 88/463* (2017.01); *A47B 88/57* (2017.01); *E05B 65/46* (2013.01); *E05F 1/16* (2013.01); *E05Y 2900/20* (2013.01)

(58) Field of Classification Search
CPC ..... A47B 88/57; A47B 88/463; E05B 63/22; E05B 65/44; E05B 65/46; E05F 1/16; E05Y 2900/20
See application file for complete search history.

(56) References Cited

U.S. PATENT DOCUMENTS 3,674,329 A 7/1972 Schill
7,374,261 B1 5/2008 Wang
(Continued)

FOREIGN PATENT DOCUMENTS

EP 2 371 241 A1 10/2011
WO 2007/028177 A1 3/2007
(Continued)

OTHER PUBLICATIONS

German Search Report (Application No. 20 2015 104 432.1) dated Jun. 1, 2016.
(Continued)

*Primary Examiner* — Daniel J Troy
*Assistant Examiner* — Ryan A Doyle
(74) *Attorney, Agent, or Firm* — Burr & Brown, PLLC

(57) ABSTRACT

A device for moving a movable furniture part, including a force accumulator for causing the movable furniture part to be put in the opening direction of the movable furniture part, and wherein the device has a locking assembly for locking a tensioned position of the force accumulator, in which the force accumulator is charged for the opening movement of the furniture part. The tensioned position of the force accumulator is unlockable by displacing an activator element that interacts with the locking assembly. The locking assembly includes a pivotably mounted locking member, and the activator element and the locking member are mutually adapted in such a manner that, for unlocking the tensioned position of the force accumulator, the activator element carries out a linear repositioning movement and comes to bear on the locking member in such a manner that the locking member is subjected to a pivoting movement, or vice versa.

10 Claims, 10 Drawing Sheets

(51) Int. Cl.

| | |
|---|---|
| ***E05F 1/16*** | (2006.01) |
| ***A47B 88/463*** | (2017.01) |
| ***A47B 88/57*** | (2017.01) |

(56) References Cited

U.S. PATENT DOCUMENTS

| | | | | |
|---|---|---|---|---|
| 8,109,582 | B2 | 2/2012 | Dubach | |
| 9,968,192 | B2 * | 5/2018 | Albrecht | E05F 15/00 |
| 9,976,331 | B2 * | 5/2018 | Albrecht | E05F 15/00 |
| 10,287,812 | B2 * | 5/2019 | Rihtarec | E05F 1/16 |
| 2016/0007750 | A1 | 1/2016 | Goetz et al. | |
| 2016/0076288 | A1 | 3/2016 | Bantle | |

FOREIGN PATENT DOCUMENTS

| | | | |
|---|---|---|---|
| WO | 2014/114514 | A1 | 7/2014 |
| WO | 2014/165874 | A1 | 10/2014 |
| WO | 2014/183909 | A1 | 11/2014 |

OTHER PUBLICATIONS

Extended European Search Report (Application No. 16183675.4) dated Jan. 12, 2017.

* cited by examiner

DEVICE FOR MOVING A MOVABLE FURNITURE PART, AND ITEM OF FURNITURE

This application claims the benefit under 35 USC § 119(a)-(d) of German Application No. 20 2015 104 432.1 filed Aug. 21, 2015, the entirety of which is incorporated herein by reference.

FIELD OF THE INVENTION

The present invention relates to a device for moving a movable furniture part, and an item of furniture.

BACKGROUND OF THE INVENTION

In the case of furniture parts such as, for example, drawers, furniture doors, or furniture flaps which are movably received on a basic furniture structure of an item of furniture, devices for influencing the movement of the furniture part are employed. Devices of this type are formed by a unit which is attachable to the furniture part or to the basic furniture structure at a suitable point, for example.

In the case of modern and user-friendly items of furniture, devices which may optionally be provided for moving the furniture part are known, for example. In particular, the device is fitted on the item of furniture so as to be separate from a sliding guide associated with the furniture part, such as a full pullout or a part pullout, or a pivoting guide, such as a hinge. An additional function for influencing the movement of the furniture part may be provided by way of the device. The additional function may be individually adapted to the type and size of the furniture part, in particular, so as to enable the furniture part to be utilized in a user-friendly manner. This relates, for example, to systems for providing an opening function having force assistance which is adaptable to the furniture part.

SUMMARY OF THE INVENTION

Proceeding from the assemblies which have been mentioned at the outset, it is an object of the present invention to advantageously provide an additional function for movement of the furniture part by means of a sliding guide, such as a full pullout or part pullout, or of a pivoting guide, in particular, so as to enable an advantageous force assistance of an opening movement for opening the furniture part on a first partial distance of the opening path of the furniture part.

The present invention proceeds from a device for moving a movable furniture part in an opening direction of the furniture part in relation to a basic furniture structure of an item of furniture, wherein the movable furniture part by way of guide means is capable of being put in the opening direction and in a closing direction which is counter to the opening direction, wherein the device comprises a force accumulator such that by way of the fitted device the movable furniture part under action of the force accumulator is capable of being put in the opening direction of the movable furniture part, and wherein the device has a locking assembly for locking a tensioned position of the force accumulator, in which the force accumulator is charged for the opening movement of the furniture part, wherein the tensioned position of the force accumulator is unlockable by displacing an activator element, interacting with the locking assembly, of the device.

The guide means for guiding the furniture part on the basic furniture structure are not part of the device according to the present invention for moving the movable furniture part.

The core concept of the present invention lies in that a pivotably mounted locking member of the locking assembly is present, wherein the activator element and the locking member are mutually adapted in such a manner that, for unlocking the tensioned position of the force accumulator, the activator element carries out a linear repositioning movement and comes to bear on the locking member in such a manner that the locking member is subjected to a pivoting movement, or vice versa. High reliability of the unlocking procedure is thus implemented in an advantageous and user-friendly manner by the device according to the present invention. In particular, it is advantageous herein that a comparatively minor activation path of the activator element is sufficient in order for interference-free and reliable activation of the locking mechanism to be achieved.

According to the reversal of the first-mentioned variant of the present invention, the present invention comprises a further variant of the present invention in which a pivotably mounted activator element is present, wherein the locking member of the locking assembly and the activator element are mutually adapted in such a manner that, for unlocking the tensioned position of the force accumulator, the activator element carries out a pivoting movement and comes to bear on the locking member in such a manner that the locking member is subjected to a linear repositioning movement. Hereunder, the focus is, in particular, on the first variant having the linearly repositionable activator element and the pivotably mounted locking member, wherein the narrative applies in a corresponding manner to the further variant.

In the case of known assemblies, instances of interference or of misactivation, respectively, are not precluded in the case of unlocking, on account of which, despite an activation attempt by a user, in which attempt the action on the furniture part or on the device, respectively, required for activation is spatially and/or temporally inadequate in terms of distance or duration, respectively, there is no cancellation or only partial cancellation of the locking mechanism, this being undesirable or potentially leading to damage, respectively.

The combination of the linear movement of the activator element and of the rotating or pivoting movement, respectively, of the locking member solves this problem in an advantageous manner. In particular, a comparatively minor activation path of the activator element in relation to a state at the beginning of the unlocking procedure is already sufficient in order for the locking member to be reliably unlocked. Preferably, the activator element at the beginning of the unlocking procedure is in contact with the locking member.

The device according to the present invention preferably serves for ejecting a drawer or for ejecting a door or a flap, respectively, being designed, in particular, as a drawer-opening or furniture-door-opening device.

The linear repositioning movement of the activator for activating the pivoting movement is preferably performed parallel with the movement of the furniture part in the closing direction, or, in particular, in the latter direction, respectively. The linear repositioning movement of the activator element is preferably performed in the direction which is transverse to a pivot axis of the locking member. In particular, the pivot axis of the locking member preferably lies in a plane which is defined by the length and the width of the device.

The activator element and the locking member in all operational states of the device advantageously bear on one another.

Preferably, one portion of the locking member is received in a material clearance on the activator element, the activator element and the locking member thus being secured against mutual releasing.

Moreover, it is advantageous for the activator element to be adapted in such a manner that the linear repositioning movement of the activator element in relation to a fitted state of the device is performed by way of a movement of the movable furniture part from a closing state of the furniture part that is predefined on the basic furniture structure in the closing direction.

The activator element is preferably repositionable by way of an ejector which is moved away from the furniture part when the furniture part is depressed in the closing direction. For example, the ejector in the case of an activation procedure for unlocking the tensioned position of the force accumulator is pushed by the furniture part in the closing direction, wherein the ejector impacts the activator, repositioning the activator in a linear manner.

To this end, the device according to the present invention is preferably equipped with a so-called touch-latch function. In the case of an integrated touch-latch function, the furniture part, which is held so as to be closed on the basic furniture structure so as to be typically in the closing position, is moved along a comparatively very short movement path of the furniture part, this being performed from the outside by a user, for example, by depressing the furniture part. The activator element is adapted such that the former, when the furniture part is being depressed, is subjected to a linear or translational movement, respectively, the locking mechanism thus being cancelled. Upon having depressed the furniture part, that is to say once the user no longer acts on the furniture part, the furniture part under the action of the charged or tensioned force accumulator, respectively, is moved from the closed or slightly inwardly depressed position, respectively, on the basic furniture structure in the opening direction. The outward movement in relation to the basic furniture structure, under the action of the force accumulator, is performed along at least a part-distance of a maximum potential opening path of the furniture part. The device according to the present invention is preferably designed such that the force accumulator is recharged by way of a closing movement of the furniture part in relation to the basic furniture structure. The effort in force required to this end is applied by the user when the user closes the furniture part again.

One advantageous design embodiment of the present invention is distinguished in that the activator element and an ejector part, repositionably mounted on the device, of the device are intercoupleable in such a manner that in the coupled state the linear repositioning movement of the activator element is performed by a repositioning movement of the ejector part in an activation direction. In particular, the activator element and the ejector part are separate components. Preferably, the activator element and the ejector part are movably mounted so as to be reversible in the same direction. The ejector part is preferably moved in relation to the device when the movable furniture part in the closed position on the basic furniture structure is pushed in the closing direction, this being performed, for example, according to the touch-latch function which is implemented on the device.

It is further of advantage that the locking member and a force-accumulator receptacle on which the force accumulator is received are present so as to be mutually spaced apart, wherein direct bearing contact between the locking member and the force-accumulator receptacle is precluded. The force-accumulator receptacle is preferably a moving component of the device, which preferably moves when the force accumulator is being tensioned and is being relaxed. Preferably, one end of the force accumulator, for example, one end of a spring pack of one or a plurality of coil springs, is fastened to the force-accumulator receptacle. The other end of the force accumulator preferably remains in a positionally fixed adjustment. A coupling installation is preferably provided between the force-accumulator receptacle and the locking member. Direct bearing contact between the locking member and the force-accumulator receptacle may advantageously be precluded by way of the coupling installation. This is advantageous with a view to the mode of action of the device, and, in particular, with a view to an effort in force for tensioning the force accumulator.

A further advantage of the present invention results from the force-accumulator receptacle being movable in an exclusively linear manner. This in terms of construction is advantageous, enabling an advantageous degree of efficiency of the force accumulator when the furniture part is being opened.

According to one advantageous modification of the present invention, the locking member knows a locking pivoted position, wherein retaining means which automatically urge the locking member in the direction of the locking pivoted position are present. It is thus ensured that the locking member implements the locking function in a durable and reliable manner. The retaining means preferably act in an uninterrupted manner. For example, the retaining means may comprise a spring element for providing a spring force, wherein the locking member by way of the spring force is urged into the locking pivoted position in a durable manner when there is no resulting larger force acting counter thereto. On the other hand, the spring element during unlocking advantageously enables the pivoting movement of the locking member out of the locking position, counter to the spring force.

In the case of the locking member being reset to the locking pivoted position, the activator element is located in a position which enables the locking member to reach the locking position. When the locking member is in the locking position, the activator element is preferably in an initial position, or a resting standby position, respectively, which is set back in a linear manner on the device and to which the activator element is brought by a spring force which acts on the activator element, for example. The standby position of the activator element accordingly differs from that position of the activator element in which the activator element is repositioned in a linear manner from the standby position, so as to bring the locking member out of the locking position.

It is moreover advantageous for transmission means having a first transmission portion on the activator element, and a second transmission portion on the locking member to be provided, wherein the two transmission portions come to bear on one another in order for the tensioned position of the force accumulator to be unlocked. The transmission portions which bear on one another are configured in such a manner so as to enable a guided, jolt-free, and stepless transmission of the linear repositioning movement of the activator element to a pivoting movement of the locking member. The transmission of movement preferably works in the same manner in a first direction, or in an activation direction, respectively, and in a second direction which is counter to the first direction. A clearance-free and precise coupling of the movement between the activator element and the locking member is thus established in particular. Moreover, the transmission portions are preferably designed in such a manner that a movement of the locking member out of the non-locking position back to the locking position enables that, by way of the transmission portions bearing on one another, the movement of the activator element back to the set-back position, or to the standby position according to a state prior to the activation procedure, respectively, is at least assisted if the activator element is not set back in any other manner.

It is further proposed that the first transmission portion and/or the second transmission portion in relation to the direction of the linear repositioning movement of the activator element have an obliquely aligned area portion. In particular, the first and the second transmission portion comprise area portions which are obliquely aligned in the same manner. For example, the transmission means may be or are, respectively, preferably configured in the manner of an inclined-surface gear box or of a sliding-wedge gear box, respectively, wherein inclined flat planar area portions or transmission surfaces, respectively, bear on one another in a planar manner. Alternatively, other assemblies for transmitting a linear movement to a pivoting movement, or vice versa, may be employed, such as, for example, a rack having a rotating sprocket engaging therein, or a reciprocating friction portion having a rotatable friction wheel bearing thereon in a frictional manner, or a flexible traction element which is guided in a friction-fitting manner about two gear means which are spaced apart and, in particular, rotate about parallel axes.

The angle of the oblique area portion in relation to the direction of the linear repositioning movement is approx. 40 to 60 angular degrees, for example.

It is also of advantage for the activator element to be mounted so as to be sprung. In particular, the sprung mounting, in relation to the linear repositioning movement of the activator element, enables an assembly such that resetting of the activator element, counter to the repositioning movement, for unlocking the tensioned position of the force accumulator is performed, in particular, automatically, for example, by way of a resetting spring, such as a coil spring or a spring-type web.

Moreover, it is proposed according to one advantageous modification of the present invention that the activator element has a clearance in which the locking member engages. In particular, engaging is performed laterally, or laterally to the linear movement direction of the activator element. This represents a space-saving construction. Moreover, this configuration is secured against mutual decoupling of the activator element and of the locking member. The locking member preferably engages in the clearance and by way of the second transmission portion comes to bear on the first transmission portion on the activator element. The first transmission portion on the activator element is preferably formed by a part of a periphery of the clearance on the activator element.

In particular, the clearance may be designed in the manner of a depression or of a groove, respectively, or of an elongate hole. The pivot axis of the locking member preferably extends in length into the clearance. In particular, the clearance is laterally open, or open toward the locking member, respectively.

It is also of advantage for the locking member in the case of a locked tensioned position of the force accumulator to form a stop for a counter portion which is coupled to the force accumulator, wherein the counter portion in the locked tensioned position of the force accumulator bears on the locking member in such a manner that a movement of the counter portion is blocked in that direction in which the counter portion moves after the tensioned position of the force accumulator has been unlocked.

The locking member in the tensioned position of the force accumulator, or in the locking state, respectively, preferably forms a mechanical stop on which the counter portion bears, the locked tensioned position of the force accumulator thus being secured. The counter portion in a biased manner bears on the locking member in such a manner that the counter portion, as soon as the locking member departs from the locking position, moves in the releasing direction, the tensioned position thus being cancelled. After the tensioned position has been cancelled, the locking member automatically and preferably by means of a spring force returns to the locking position. Resetting to the locking position of the locking member is preferably performed within a time duration in which the force-assisted opening movement of the movable furniture part is performed with the force accumulator. The state in which the force accumulator is located is irrelevant herein. In the case of renewed tensioning of the partially discharged or partially relaxed force accumulator, respectively, the locking member is already located in the locking position again. Preferably, during the entire tensioning of the force accumulator the locking member remains motionless in the locked position. Therefore, the counter portion is preferably designed such that the counter portion by way of a yielding movement, or in a yielding manner, respectively, bypasses the locking member so as to reach the locked tensioned state of the force accumulator. To this end, it is necessary for the counter portion by way of the yielding movement to bypass the mechanical stop since the locking member does not yield or pause in the locking position, respectively. A reversed assembly which includes yielding by the locking member would be disadvantageous, in particular, because the locking member would potentially not return back to the locking position in good time or only in an incomplete manner.

Moreover, the present invention extends to an item of furniture having a basic furniture structure and a movable furniture part which by way of guide means is capable of being put in an opening direction of the furniture part and in a closing direction which is counter to the opening direction relative to the basic furniture structure, wherein a device as explained above is provided. The advantages which have been explained may thus be implemented on the item of furniture. In particular, it is preferable herein that the guide means are equipped with a full pullout, for example, having an automatic retraction feature for retracting the as-yet not completely closed furniture part in relation to the basic furniture structure. Synchronization of the touch-latch function of two respective devices which are present is also advantageously provided. The furniture part is configured as a drawer, for example, which by way of two lateral full pullouts is movably received so as to be displaceable on mutually opposite side walls of the basic furniture structure.

BRIEF DESCRIPTION OF THE DRAWINGS

Further features and advantages of the present invention are explained in more detail by means of exemplary embodiments which are schematically illustrated in the figures.

DETAILED DESCRIPTION OF THE INVENTION

Figure 1:
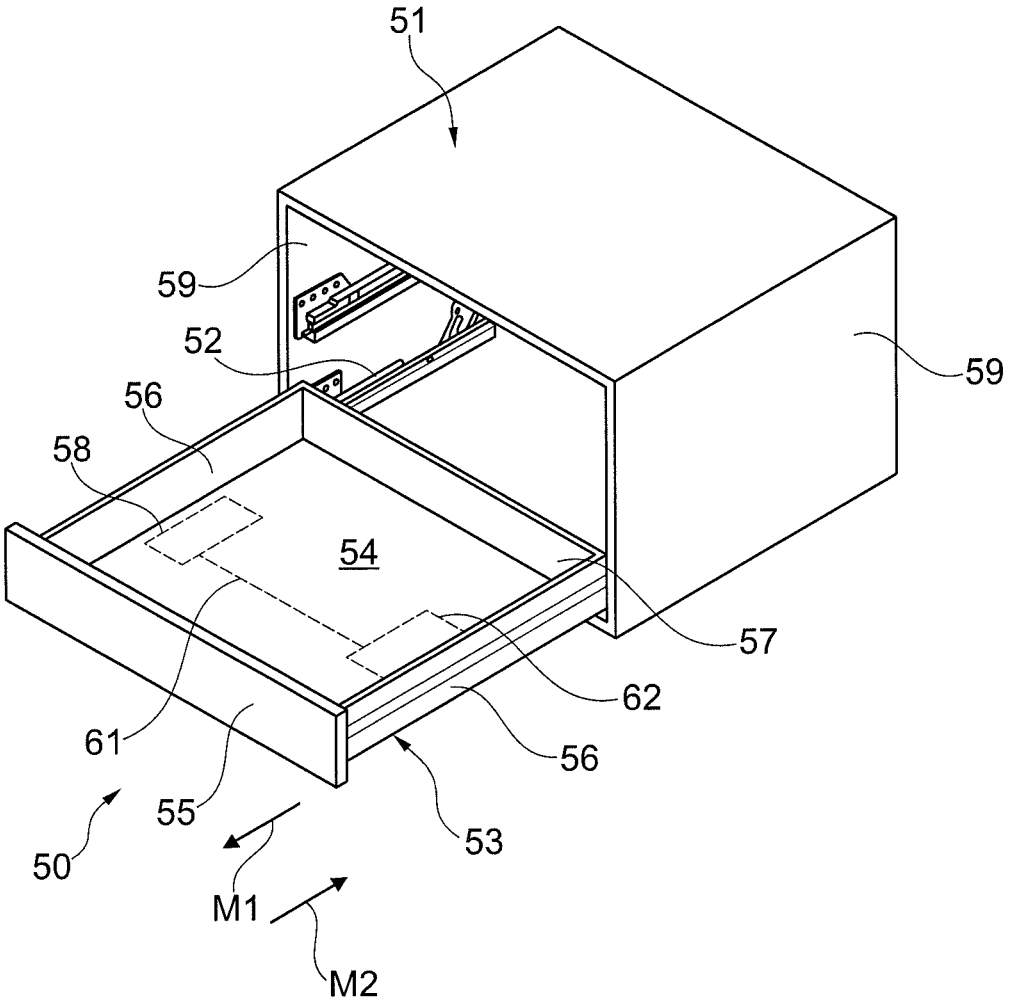
FIG. 1 shows an item of furniture according to the present invention in a perspective view from obliquely above, having a drawer in the completely opened state on a basic furniture structure.

An item of furniture 50 according to the present invention, having a box-shaped basic furniture structure 51 and a drawer 53 which by way of guide means 52 is movably guided, is illustrated in FIG. 1. The drawer 53 comprises a drawer base 54, a drawer front 55, two mutually opposite side walls 56, and a rear drawer wall 57. Two guide means 52 with identical action for guiding the drawer 53 are present in each case between each side wall 56 of the drawer 53 and an associated basic-structure side wall 59. A device 58 according to the present invention (illustrated with dashed lines), for moving or ejecting, respectively, the furniture part which is configured as a drawer 53 in the opening direction M1 is disposed on a lower side of the drawer base 54.

Figure 2:
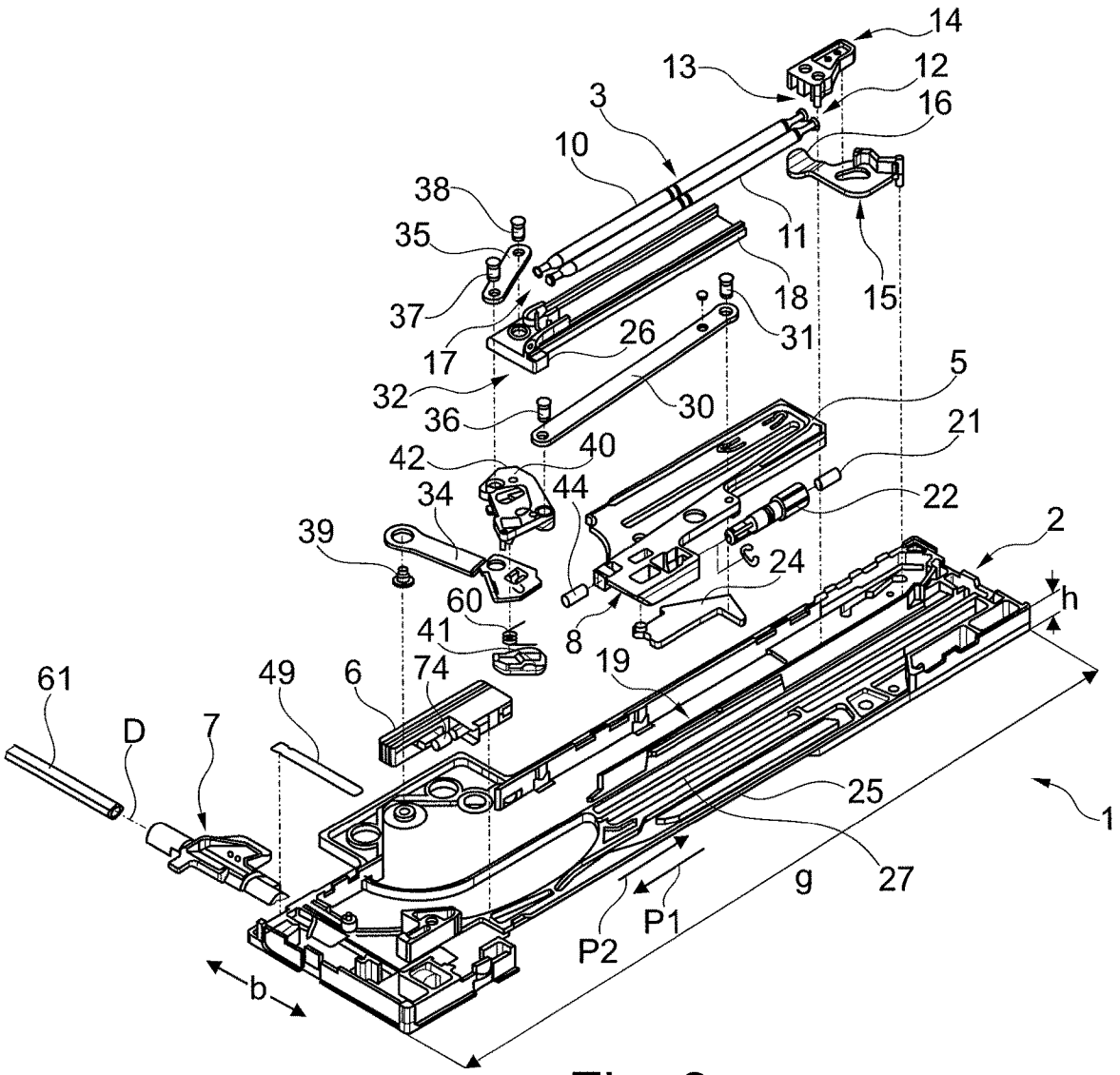
FIG. 2 shows a device according to the present invention, without a cover component, in an exploded illustration.

FIG. 2 shows the exploded illustration of the device 58 which is configured as an ejector unit 1 for the drawer 53.

The ejector unit 1 serves for the force-assisted ejection of the drawer 53 across a first part-distance of the opening movement of the drawer 53 in relation to the basic furniture structure 51, from a closed position in the opening direction M1 of the drawer.

The drawer 53 by way of the guide means 52, for example, two identical part pullouts or full pullouts, is mounted on the basic furniture structure 51 so as to be displaceable in the directions M1 and M2.

Alternatively, the ejector unit 1 may be disposed on the basic furniture structure 51 or on the guide means 52 of the item of furniture 50.

The ejector unit 1 comprises inter alia a base plate 2, a force accumulator 3, a coupling installation 4, an ejector 5, an activation element which is configured as an activator 6, and a locking member 7.

Figure 9:
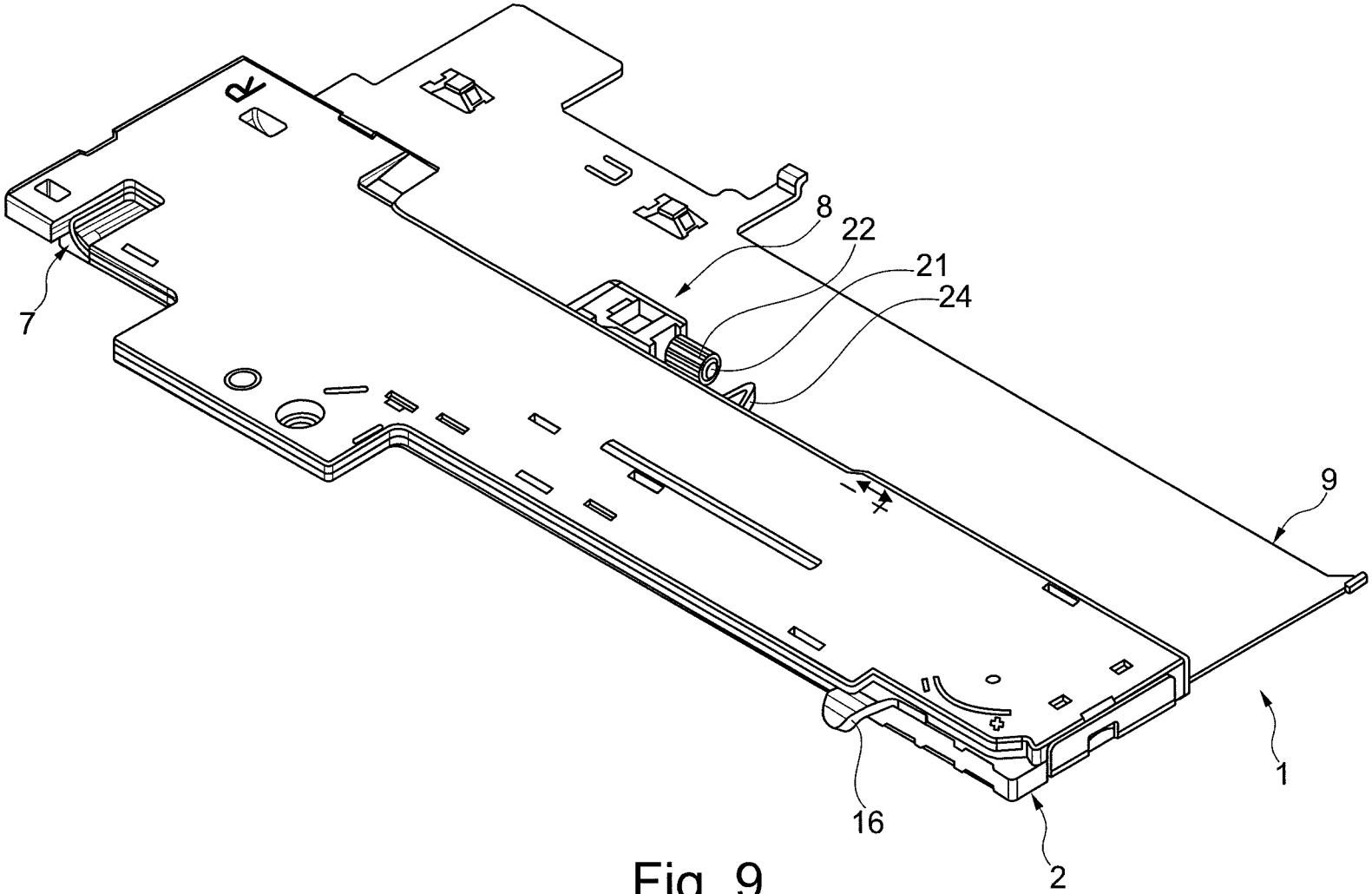
FIG. 9 shows the device according to FIG. 5, having the cover component, in a perspective view from obliquely below toward a second main side of the device.

A housing of the ejector unit 1 comprises the base plate 2 and a cover component 9 which is visible in FIG. 9. The ejector unit 1 may be disposed on the lower side of the drawer base 54 and/or on the guide means 52 by way of the housing or by way of the cover component 9 and/or the base plate 2, respectively.

Retaining portions, guide contours, stop members, and/or receptacle portions for linking the individual components of the ejector unit 1 are configured on the base plate 2. The base plate 2 is designed substantially as a rectangular, elongate or strip-shaped component, having a comparatively minor height h of approx. 5 to 15 millimeters, for example. The base plate 2 furthermore has a width b of approx. 4 to 10 centimeters, and a length g.

According to the exemplary embodiment shown, the force accumulator 3 comprises two identical coil springs 10, 11 which configure a spring pack and which are disposed in parallel. At a first end 12 of the force accumulator 3, the coil springs 10, 11 are disposed on an adjustable fixed mounting 13. The fixed mounting 13 comprises a movable mounting part 14 on which the coil springs 10, 11 are received in a releasable yet fixed manner, and a set part 15 having an operating portion 16 by way of which a user may adjust from the outside a position of the end 12 of the force accumulator 3 in a modifiable and positionally fixed manner. On account thereof, an effect of force of the force accumulator 3 on the drawer 53 may advantageously be pre-adjusted in the case of the opening procedure of the drawer 53.

The associated ends of the coil springs 10, 11 are fastened to a slide-type motion element 18 as a force-accumulator receptacle at a second end 17 of the force accumulator 3. The slide-type motion element 18 by way of an associated guide contour 19 is linearly guided on the base plate 2 so as to be movable in a movement direction P1 and in an opposite movement direction P2.

The movement directions P1 and P2 of the motion element 18 (cf. FIGS. 2 and 3) run parallel with the opening direction M1 of the drawer 53 and with a closing direction M2 which is counter thereto.

If and when the ejector unit 1 is disposed in a positionally fixed manner on the basic furniture structure 51 and/or on a stationary part of the guide means 52, the opening direction of the drawer 53 corresponds to the direction P1, and the closing direction of the drawer 53 corresponds to the direction P2.

Herebelow, an assembled state of the ejector unit 1 on the drawer base 54 is assumed.

Figure 3:
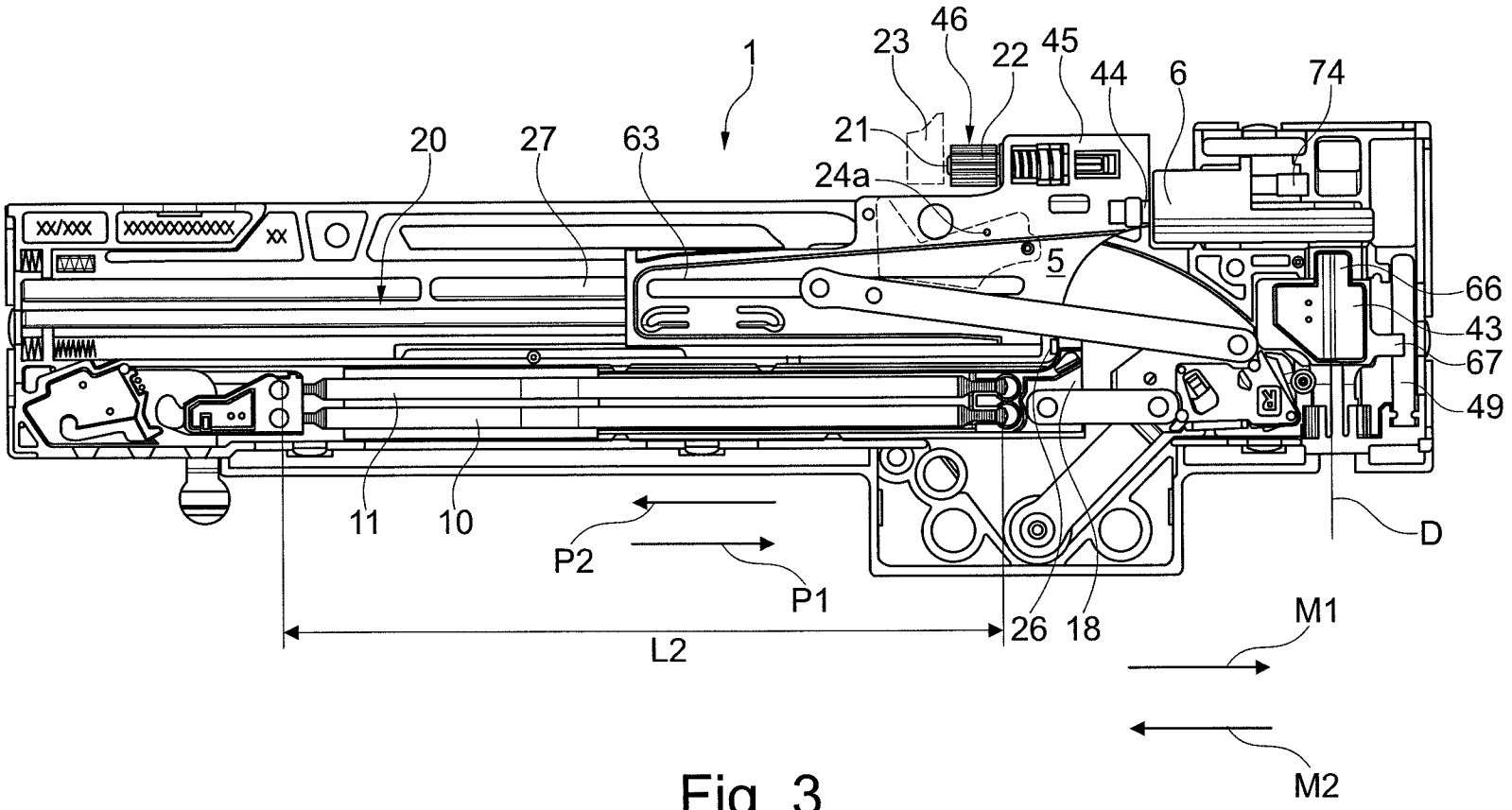
FIGS. 3 to 8 show the device according to FIG. 2, in an assembled state, in a plan view of a first main side, in various operational states.
Figure 7:
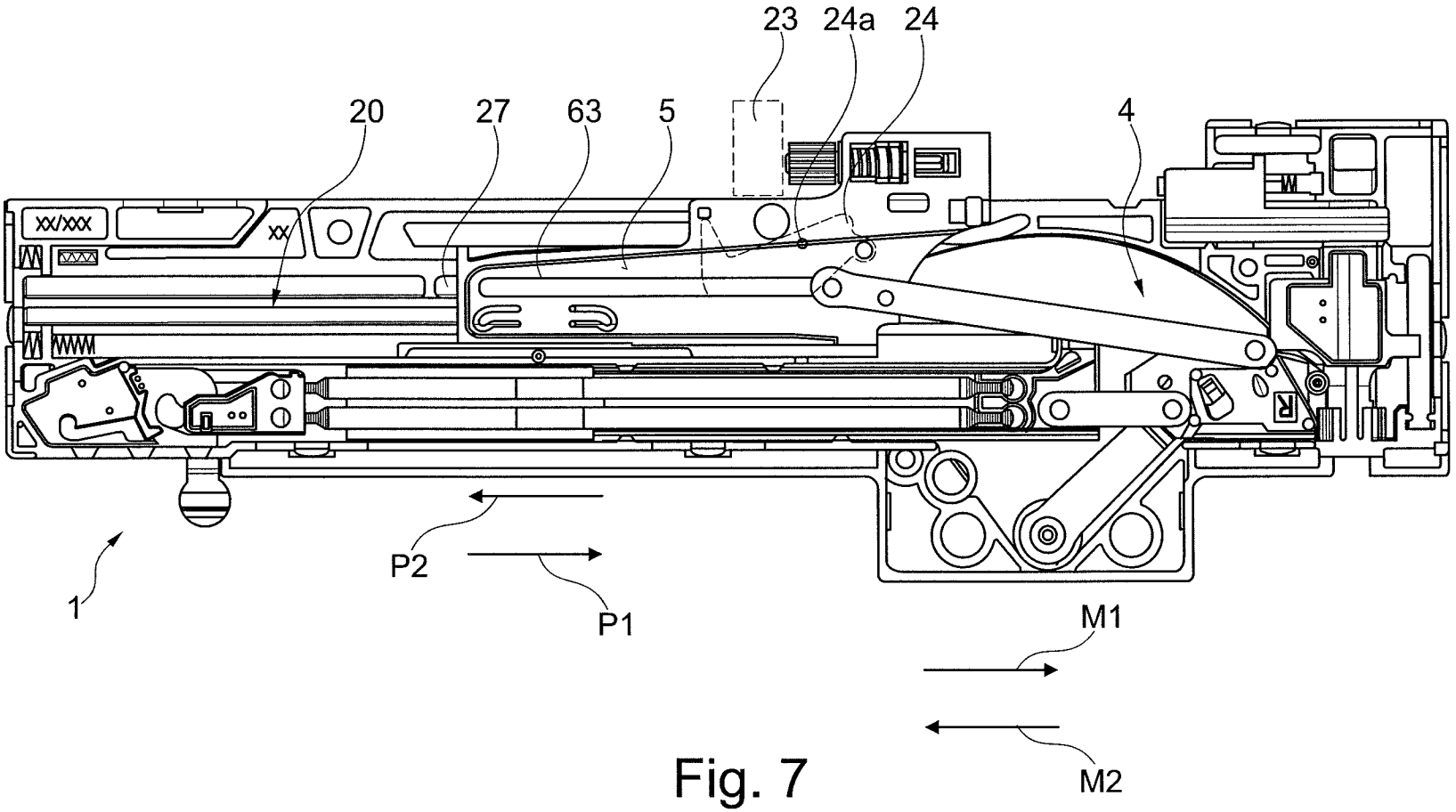
Figure 8:
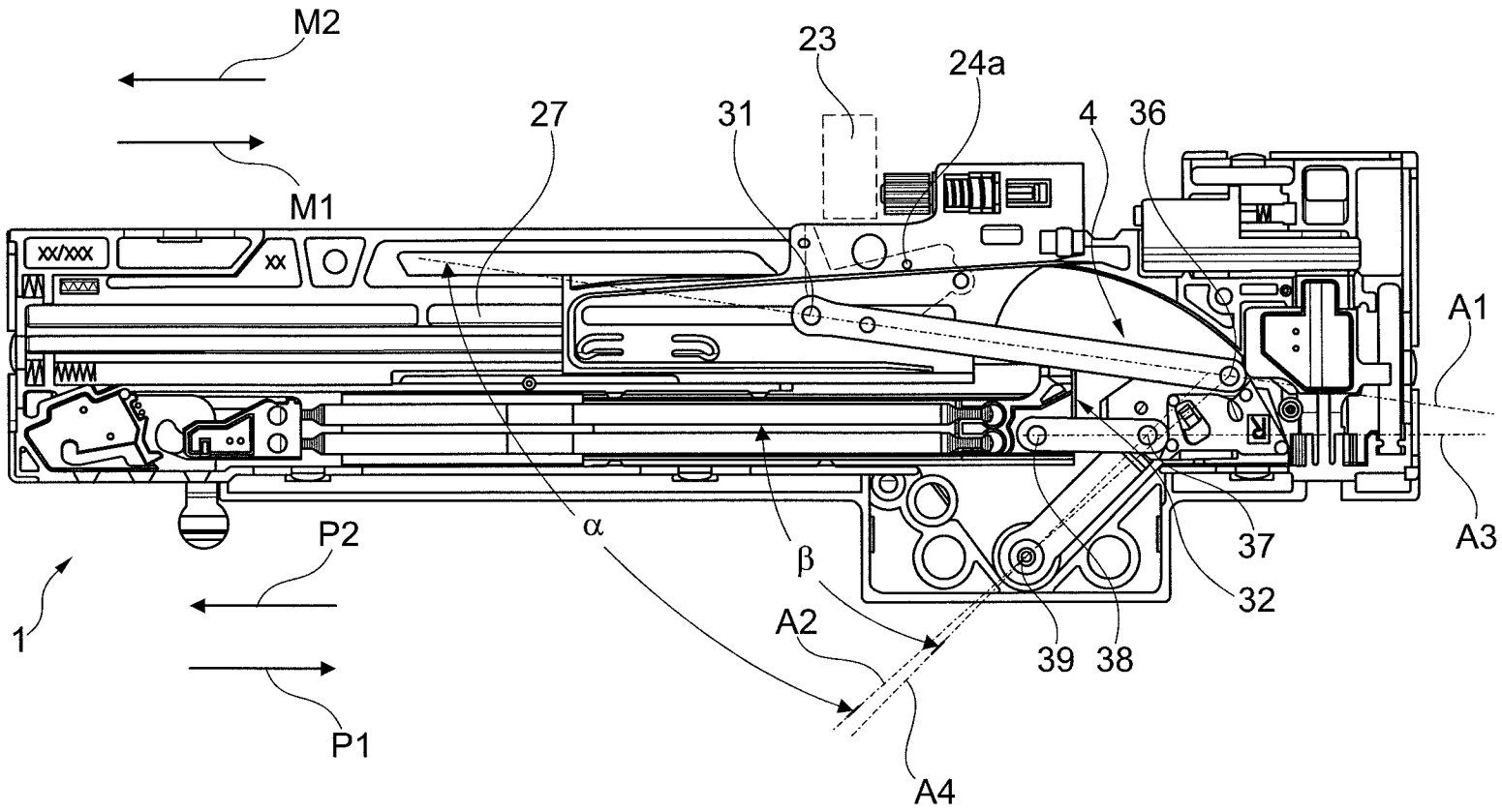

FIGS. 3, 7 and 8 show the ejector unit 1 in a tensioned state of the force accumulator 3, in which the coil springs 10, 11 are elongated or are tensioned so as to be under a tensile load, respectively; herein, the motion element 18 in relation to a retracted position in the direction P2 is offset on the base plate 2 in the direction P1 and is retained in a tensioned position.

Figure 5:
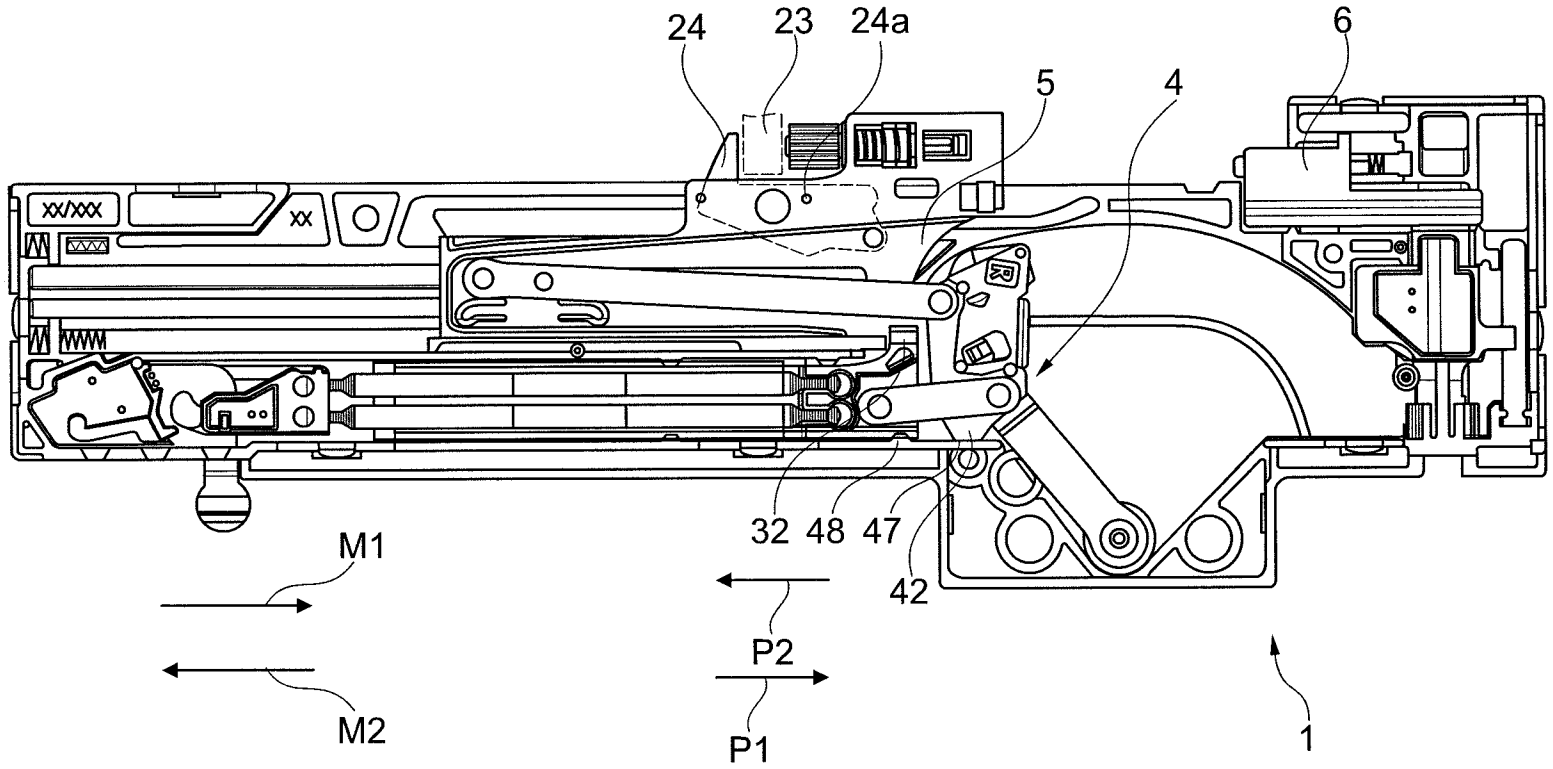
Figure 6:
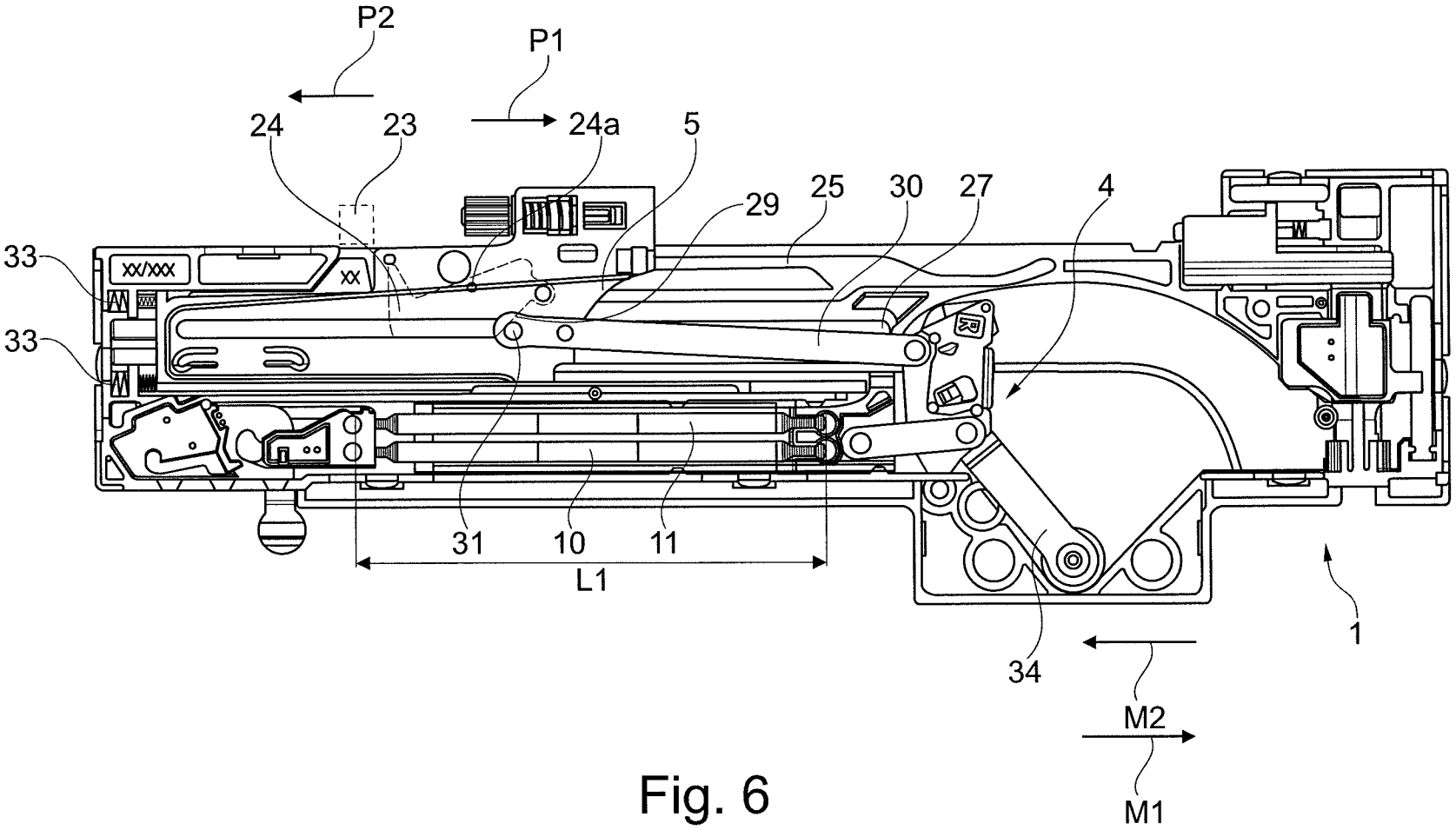

FIGS. 5 and 6 show the ejector unit 1 in a discharged basic state of the force accumulator 3, in which the coil springs 10, 11 are furthermore pretensioned under a tensile load but to a lesser degree, having a length L1.

In the tensioned state of the force accumulator 3 the coil springs 10, 11 have a length L2 which is greater than L1.

A retaining member 32 having a stop element 26 is present on the motion element 18. The stop element 26 in the case of a force-assisted opening procedure is in contact with an ejector 5.

By way of the coupling installation 4, the force accumulator 3 or the motion element 18, respectively, is operationally connected to the ejector 5, preferably exclusively in the case of the closing procedure of the drawer 53. In particular, the ejector 5 is movable to and fro exclusively in a linear manner, or so as to be parallel with the movement direction of the motion element 18, respectively, in the directions P1 and P2. To this end, a linear guide 20 which is adapted to guide portions, for example, on one side of the ejector 5, is configured on the base plate 2.

Figure 4:
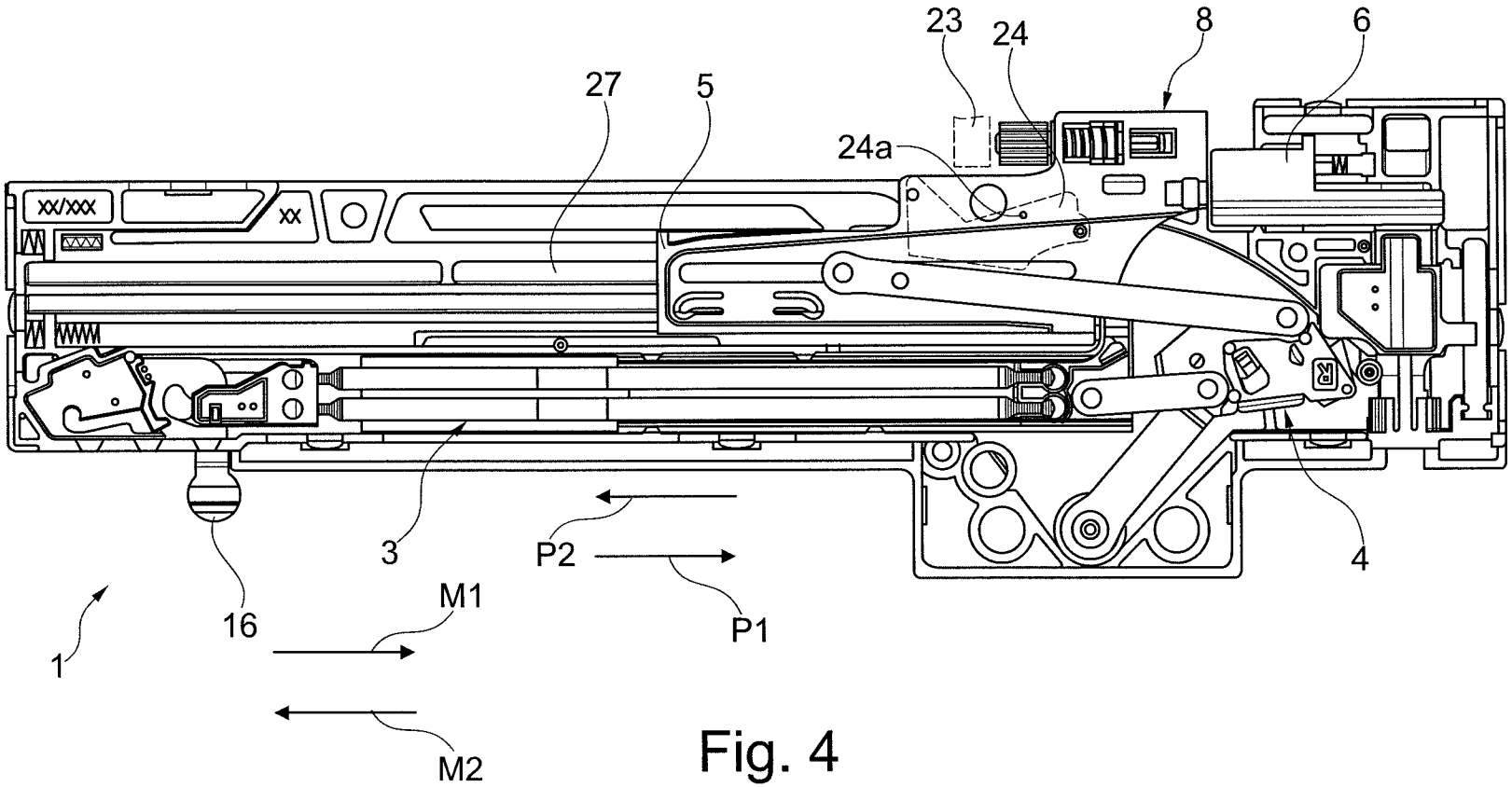

An opening procedure of the drawer 53, caused by the ejector unit 1, takes place exclusively by way of a direct operational connection of the force accumulator 3 to the ejector 5, by way of the motion element 18 which moves in the direction P2. To this end, a stop element 26 which is advantageously designed so as to be elastic and thus prevents or at least dampens any sound which is disturbing to a user when the motion element 18 impacts the ejector 5 in the opening procedure of the drawer 53 is configured on the motion element 18 (FIGS. 3, 4 and 5).

A front-gap adjustment assembly 8 which is configured on the ejector 5 comprises a housing 45 and a set screw 22 having a contact portion 21. The set screw 22 has an external thread which interacts with an internal thread on the housing 45. Depending on the rotation direction, a position of the contact portion 21 of the set screw 22 is adjustable in the direction P1 or P2 by manual rotation of an operating portion 46 of the set screw 22 by a user. In particular, the set screw 22 is configured so as to be self-locking in relation to the housing 45. A measure of a front gap between the drawer front 55 of the drawer 53, which is closed on the basic furniture structure 51, and end sides of the basic furniture structure 51 is capable of being predefined by way of the predefined position of the set screw 22.

The contact portion 21 of the set screw 22 in the tensioned or charged state, respectively, of the force accumulator 3 bears on an entrainment element 23 which in respective operational states forms a stop for the contact portion 21. The entrainment element 23 which in FIGS. 3 to 8 is merely indicated by dashed lines may be present on a fixed rail of the guide means 52, for example, or be attached to the basic furniture structure 51 when the ejector unit 1 is disposed on the drawer 53.

However, if and when the ejector unit 1 is disposed on the basic furniture structure 51 or on a positionally fixed part of the guide means 52 of the item of furniture 50, the entrainment element 23 may be present on the drawer 53 and thus be movable in relation to the basic furniture structure 51.

If and when, proceeding from the basic position of the ejector unit 1 according to FIG. 3, a locking feature is cancelled on the ejector unit 1, as is shown in FIG. 4 and will be explained in more detail below, the tensioned or charged force accumulator 3, respectively, pulls the motion element 18 in the direction P2, the latter by way of the stop element 26 urging or sliding, respectively, the ejector 5 in relation to the base plate 2 in the direction P2.

As soon as the ejector 5 on the base plate 2 moves in the direction P2, a latch component 24 of the ejector unit 1, which is pivotably mounted on the ejector 5, is put from an inwardly pivoted position according to FIG. 4, in which the latch component 24 in relation to an external periphery of the base plate 2 is completely retracted, to an outwardly pivoted position in which the latch component 24 by way of a cam partially projects beyond the external periphery of the base plate 2 (FIG. 5), this being implemented by way of a loop-shaped closed guide track 25 in the base plate 2 and by way of a guide pin 24*a*, engaging in the guide track 25, on the latch component 24.

In order for the latch component 24 to be illustrated, the outline thereof which is obscured by other components, in particular, by the ejector 5, in FIGS. 3 to 8 is indicated with dashed lines.

In the basic state which is illustrated in FIG. 5, the force accumulator 3 is located in a terminal position of the discharged state, wherein the force accumulator 3 is unable to move the ejector 5 any farther in the direction P2.

By virtue of the kinetic energy of the drawer 53, caused by the preceding ejection movement and/or by manually moving the drawer 53 farther in the opening direction M1 by a user, the ejector 5 is subsequently displaced in relation to the base plate 2 in the direction P2. This is possible because the latch component 24 which has been outwardly pivoted so as to project from the ejector 5 bears on the entrainment element 23, the ejector 5 in the further course of the movement of the drawer thus reaching the terminal position thereof which is displaced to a maximum in the direction P2 on the base plate 2. By reaching the terminal position on the ejector 5, the latch component 24 is again completely pivoted inwardly, this being predefined by the interaction between the guide track 25 and the guide pin 24*a* on the latch component 24 being engaged therein.

If and when the drawer 53 following a discharging procedure of the force accumulator 3 is moved farther in the opening direction M1, the ejector unit 1 separates from the entrainment element 23, cancelling contact between the entrainment element 23 and the contact portion 21 of the set screw 22 (FIG. 6).

From the terminal position described above, which the ejector assumes only briefly, the ejector 5 by spring elements 33 on the base plate 2 is urged by a few millimeters in the direction P1, for example. In relation to the coil springs 10, 11 of the force accumulator 3, the spring elements 33 have a comparatively minor force. By way of the movement of the ejector 5 in the direction P1 by way of the force of the spring elements 33, a bearing portion 29 of the latch component 24 in a standby position of the ejector 5 is put in direct clearance-free contact with a mounting pin 31 of a tension lever 30 of the coupling installation 4 (FIG. 6). The mounting pin 31 is disposed on a first end of the tension lever 30 and may move freely along a, for example, linear, guide track 27 and/or a linear guide 63 which is configured on the ejector 5 for so long, and, in particular, within an opening procedure of the drawer 53, until the latch component 24 holds the mounting pin 31 and/or the tension lever 30 in direct, clearance-free contact with the ejector 5.

The standby position of the ejector 5 which is shown in FIG. 6 at the same time is a starting position of the ejector 5 for a charging procedure of the force accumulator 3 by way of the coupling installation 4.

Besides the tension lever 30, the coupling installation 4 comprises a guide lever 34 and a connection element 35. By way of a mounting pin 36, the tension lever 30 on a second end is articulated on the guide lever 34. The connection element 35, on a second end, by way of a mounting pin 37 which is spaced apart from the mounting pin 36, is likewise articulated on the guide lever 34, and on the first end thereof, the connection element 35 by way of a further mounting pin 38 is articulated on the motion element 18. The guide lever 34 at a first end by way of a mounting pin 39 is disposed so as to be movable, in particular, pivotable, on the base plate 2. The mounting pin 39 is preferably received both on the base plate 2 as well as on the cover component 9.

A longitudinal axis A1 of the tension lever 30, which runs through the mounting pins 31, 36 of the tension lever 30, in relation to a first longitudinal axis A2 of the guide lever 34, which runs through the mounting pins 36, 39, has an angle $\alpha$.

A longitudinal axis A3 of the connection element 35, which runs through the mounting pins 37, 38 of the connection element 35, in relation to a second longitudinal axis A4 of the guide lever 34, which runs through the mounting pins 37, 39, has an angle 3.

The guide lever 34 of the coupling installation 4, on a second end, comprises a lever attachment 40. A locking element 41 and a stop element 42 are configured on the lever attachment 40.

The terminal position of the discharged state of the force accumulator 3 (FIG. 5) is predefined by a stop of the stop element 42 of the guide lever 34 on a wall portion 47 on a web-type wall 48 of the base plate 2. The wall portion 47 is formed from an annular portion of a damping element, for example. If and when the stop element 42 of the guide lever 34 following a discharging procedure of the force accumulator 3 bears on the wall portion 47, by virtue of a remaining bias of the coil springs 10, 11 a tensile force in the direction P2 is transmitted from the motion element 18 by way of the connection element 35 to the guide lever 34. By virtue of the rigid embodiment of the coupling installation 4, or by virtue of the impact of the stop element 42 on the wall portion 47, respectively, the motion element 18 is prevented from moving farther in the direction P2, wherein the force accumulator by way of the motion element 18 is held free of clearance in the terminal position of the discharged state.

In particular, the stop element 42 and/or the wall portion 47 may be designed so as to be elastic or damping, respectively, thus reducing or preventing an impact noise.

When tensioning the force accumulator 3, the guide lever 34 by virtue of the design thereof may transmit a force from the tension lever 30 to the connection element 35 at a geared ratio.

The gear ratio is formed, on the one hand, by the ratio of the spacing of the mounting pins 39 and 36 in relation to the spacing of the mounting pins 39 and 37 on the guide lever 34 and, on the other hand, by the combined mutual circular and linear movement of the tension lever 30 and/or of the connection element 35 during the charging procedure of the force accumulator 4.

The elements of the coupling installation 4, by virtue of the arrangement of the former on the ejector unit 1, may move as follows:

The mounting pin 31 and thus the first end of the tension lever 30, by virtue of the mounting thereof in the guide track 27, may move exclusively parallel with a movement direction of the ejector 5, in particular, parallel with a movement direction of the movable furniture part 53.

The mounting pin 38 and thus the first end of the connection element 35, by virtue of the mounting thereof on the slide-type motion element 18 and thus advantageously in the guide contour 19, may move exclusively parallel with a movement direction of the motion element 18 or of the ejector 5, respectively, in particular, parallel with the movement direction of the movable furniture part 53.

The mounting pin 36 and thus the second end of the tension lever 30, by virtue of the mounting thereof at the second end of the guide lever 34, may move exclusively in a circular path about a rotation center of the mounting pin 39 of the guide lever 34.

The mounting pin 37 of the connection element 35 and thus the second end of the connection element 35, by virtue of the mounting thereof in a central region of the guide lever 34, may move exclusively in a circular path about a rotation center of the mounting pin 39 of the guide lever 34.

By virtue of the above-mentioned design, the coupling installation 4 may transmit at a geared up ratio a force for tensioning the force accumulator 3 from the ejector 5 by way of the tension lever 30 and of the guide lever 34 to the connection element 35 and thus to the force accumulator 3, and, in particular, transmits the force which is exerted by the ejector 5 in a geared down ratio to the force accumulator 3. This means that a user when charging the force accumulator 3 has to apply less force at the ejector 5 than the user would have to apply when wishing to charge the force accumulator 3 without gearing down, or when directly pulling the end 17 of the force accumulator 3 in the direction P1, respectively.

The beginning and the end of the charging procedure of the force accumulator 3 or of the coil springs 10, 11, respectively, is visualized in FIGS. 6 and 7.

Tensioning of the force accumulator 3 is performed by a movement of the drawer 53 in the case of closing, or on a part-distance of the closing movement of the drawer 53. The starting position of the ejector unit 1, in which the latter is prepared for tensioning of the force accumulator 3 and expects a closing procedure of the drawer, is shown in FIG. 6.

If and when the drawer 53 is closed, for example, from the outside by a user, the ejector unit 1 moves in the direction M2 toward the entrainment element 23. The charging procedure of the force accumulator 3 begins as the contact portion 21 of the set screw 22 of the ejector 5 impacts on the entrainment element 23. The ejector 5, by impacting on the entrainment element 23, is moved in the direction P1, for example, by virtue of the inertia of the drawer 53 in relation to the base plate 2.

By way of the coupling of the ejector 5 to the force accumulator 3 by way of the coupling installation 4, the motion element 18 of the force accumulator 3 is likewise displaced in relation to the base plate 2 in the direction P1, and the second end 17 of the coil springs 10, 11 is displaced in the direction P1, the coil springs 10, 11 thus being elongated.

At the end of the tensioning procedure of the force accumulator 3, the ejector 5 is located in a terminal charging position, as is shown in FIG. 7. In the tensioned state of the force accumulator 3, the ejector unit 1 is located in a locked state.

In the locked state, a locking state is determined by the locking element 41 of the coupling installation 4 and by the locking member 7 which is configured as a flap, wherein a discharging movement of the coupling installation 4 is blocked by the locking member 7.

Tensioning of the force accumulator 3 is fully completed prior to an automatic retracting feature for the force-assisted retraction of the drawer 53 to the fully closed closing position on the basic furniture structure 51 becoming effective, for example. The automatic retracting feature is not part of the ejector unit 1, and is integrated in the guide means 52 or in the part pullouts or full pullouts, respectively.

After the force accumulator 3 has been tensioned, the ejector 5 by virtue of bearing on the entrainment element 23 is moved in the direction P1 in relation to the base plate 2 by way of the further closing movement of the drawer 53. Herein, the operational connection between the latch component 24 of the ejector 5 and the mounting pin 31 of the tension lever 30 is cancelled. This is performed by an interaction between the guide track 25 and the guide pin 24*a* on the latch component 24, wherein the latch component 24 by the guiding of the guide pin 24*a* in the guide track 25 is pivoted away from the mounting pin 31 (FIG. 8). In this state, the ejector 5 is uncoupled from the coupling installation 4 and is displaceable so far in the direction P1, in particular, by an automatic retracting feature, until the drawer 53 is fully closed on the basic furniture structure 51, and the ejector 5 bears on the activator 6 in the basic position according to FIG. 3.

In the basic position of the ejector unit 1 according to FIG. 3, it is possible for a user to pull the drawer 53 in the opening direction M1 without an ejector function or without first manually cancelling the locking state, respectively. Herein, the force accumulator 3 of the ejector unit 1 is non-actuated or charged, respectively.

In order for the drawer 35 by way of the ejector unit 1 to be expelled from the position in which the drawer 35 is completely retracted or closed, respectively, on the basic furniture structure 51, a user has to act on the drawer while pushing from the outside in the direction M2. To this end, the ejector unit 1 has a so-called touch-latch function which knows a locked state which is unlockable in that the retracted drawer 53 which is closed on the basic furniture structure 51 is moved in the closing direction M2. This closing movement, or inward pushing of the drawer 53 in the direction M2, respectively, is performed until a stop position corresponding to a front gap which in the closed state of the drawer 53 is predefined, in particular, by way of a spacing between an internal side of the drawer front 55 and a forward end side or the side walls 56 of the basic furniture structure 51, respectively, is reached. The front gap is typically a few millimeters, for example, approx. 1 to 10 millimeters.

Accordingly, unlocking of the ejector unit 1 is adapted in such a manner that a closing movement of the drawer 53 in the direction M2 of a few millimeters, or at maximum by the value of the front gap, respectively, is sufficient for unlocking and thus the force-assisted ejection of the drawer 53 to be reliably predefined.

Proceeding from the basic position according to FIG. 3, the ejector unit 1 together with the drawer 53 is moved in the direction M2. Since the set screw 22 bears on the entrainment element 23, the ejector 5 is moved in relation to the base plate 2 in the direction P1, a contact portion 44 on the ejector 5 thus pressing against the activator 6, accordingly pushing the latter in the direction P1. The activator 6 is present on the base plate 2 so as to be linearly displaceable in a limited manner, typically by a few millimeters or by less than the dimension of the front gap, respectively, in the directions P1 and P2.

The activator 6 is preferably directly coupled to the locking member 7 which is designed as a flap 43 in such a manner that the linear activation movement of the activator 6 in the direction P1 sets the flap 43 in rotary motion about a pivot axis D. In order for the flap 43 to be rotated or pivoted, respectively, the former on the lower side has a linear elevation which is outwardly curved in a convex manner, or projects in a downward manner, respectively, and which lies so as to fit in a corresponding straight furrow which is shaped in a concave manner or is depressed, respectively, in the base plate 2.

The flap 43 by the rotating movement is released from a locking position into which the flap 43 is urged by a spring member which is configured as a leaf spring 49. In the locked state of the ejector unit 1, the flap 43 which is located in the locking position blocks the guide lever 34 or the lever attachment 40, respectively, in such a manner that the force accumulator 3 remains in the charged state thereof.

Blocking of the guide lever 34 is cancelled by way of the rotating movement of the flap 43 in the direction for cancelling the locking mechanism. The lever attachment 40 comes to bear on the locking element 41 which is biased by a leg spring 60 in such a manner when moving past the flap 43 that the locking element 41, counter to the spring force of the leg spring 60, is pushed inwardly on the lever attachment.

The locking element 41, which projects from the lever attachment 40, moves conjointly with the pivoting procedure of the guide lever 34 below the flap 43, past the latter, and continues without interruption the rotating movement of the flap 43, initiated by the activator 6, about the pivot axis D. On account thereof, a rotation angle of the flap 43 out of the locking position is advantageously enlarged. The ejector unit 1 is reliably unlocked by the movement of the lever attachment 40 below and past the flap 43 and continued by the outwardly pivoting locking element 41. To this end, a comparatively very minor linear activation movement of the activator 6 in the direction P1 is advantageously required. Subsequently, the flap 43 by the leaf spring 49 is urged back into the locking position of the former.

The locking element 41 which is present so as to be outwardly pivoted on the lever attachment 40 is again brought to bear on a front edge of the flap 43 when the force accumulator 3 is tensioned. Herein, the locking element 41 yields counter to the spring force of the leg spring 60, such that the locking element 41 is retracted so far on a periphery of the lever attachment 40 that the guide lever 34 by way of the lever attachment 40 can pivot past the flap 43.

Behind the flap 43, the locking element 41 is outwardly pivoted again by the spring force of the leg spring 60. Following the tensioning procedure, the guide lever 34 by way of the projecting locking element 41 is pushed against the flap 43 which is held by the leaf spring 49 so as to lock, the force accumulator 3 thus being in the locked state.

The rotating movement of the flap 43 of the ejector unit 1, or of the device 58, respectively, is transmitted by a synchronizer bar 61 which is disposed so as to be rotationally fixed on the flap 43 to a second device 62 which is advantageously of identical action and which is disposed on the drawer 53.

The synchronizer bar 61 advantageously connects the locking member 7 to a second locking member which is present on the second device 62. The two locking members are thus directly and/or synchronously coupled in terms of motion. This represents a synchronizing principle which is contrary to a connection between activator elements of two ejector units on one furniture part.

Figure 10:
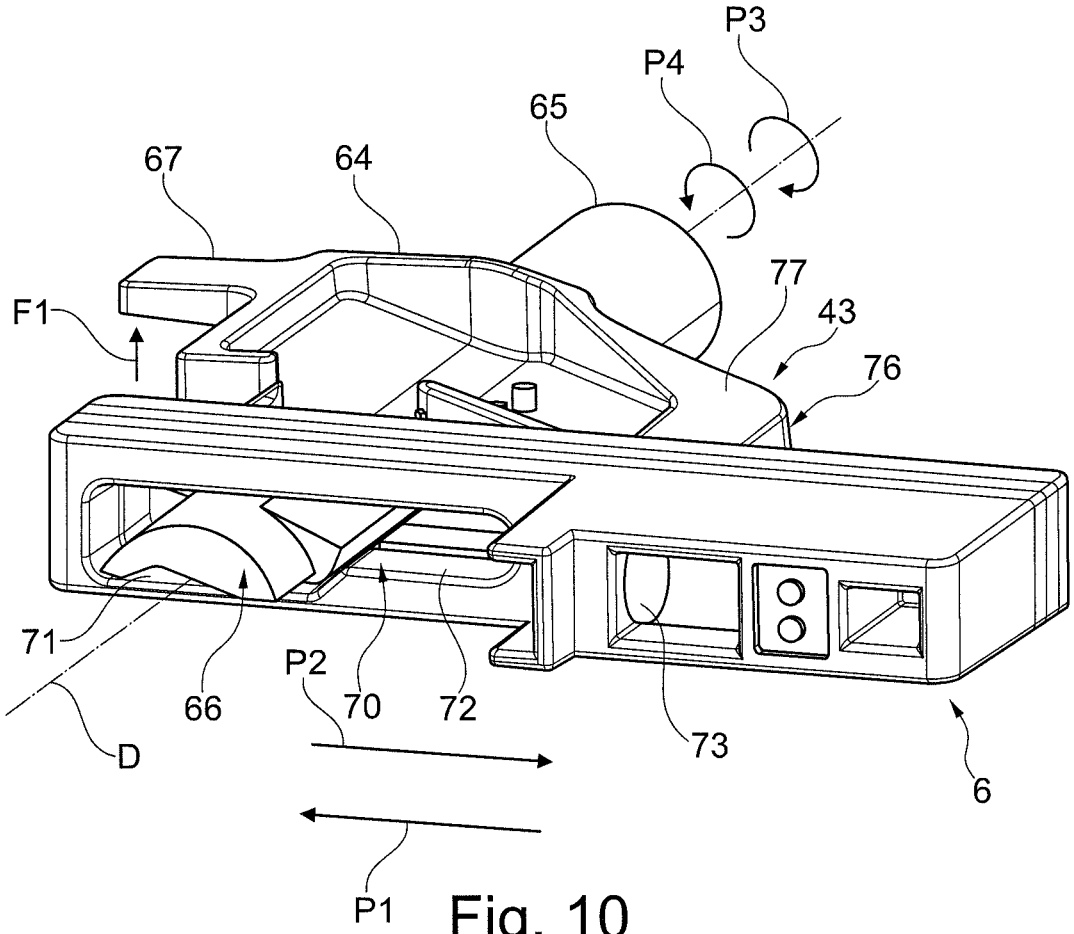
FIG. 10 shows an activator element and a locking member in a perspective view, in a standby position of the activator element.

FIG. 10 in a perspective manner shows the activator 6 in a standby position, and the locking member 7 which is designed as a flap 43 in a locking position. This state is established in the case of a closed drawer 53 as per FIG. 3. The two pivoting directions of the flap 43 about the rotation axis D are indicated in FIG. 10, so as to correspond to P3 and to P4, the latter being the opposite rotation direction. The activator 6 is guided laterally and in a supported manner by way of a flat lower side 75 on the base plate 2. By way of the leaf spring 49 which is not illustrated in FIGS. 10 and 11, a force F1 acts on the flap 43 in order to provide a torque about the rotation axis D, which torque urges the flap 43 in the direction P3, or moves the flap 43 to the pivoted position in which the latter bears on the activator 6. The activator 6, likewise under the action of a spring 74, is in the standby position (cf. FIG. 2).

The flap 43 which is designed as a lever with two arms comprises a central portion 64 having a tongue 67 and a wing-type appendage 77, a stop face 76 being configured on the latter. A clamp-type receptacle 65 for releasably plug-fitting an end of the synchronizer bar 61 (cf. FIG. 2) adjoins the central portion 64 on a side which faces away from the activator 6. The longitudinal axis of the synchronizer bar 61 coincides with the rotation axis D. The flat tongue 67 on which the leaf spring 49 presses from below with the force F1 projects from the central portion 64 on a side which lies in the direction P1. The leaf spring 49 and the tongue 67 are parts of retaining means which automatically urge the flap 43 in the direction P3, or in the direction of the locking position, respectively, when there is no comparatively large counter torque acting in the direction P4 on the flap 43.

A transmission portion 66 is present on that side of the central portion 64 that is opposite the receptacle 65. Here, the transmission portion 66 is designed having a curved upper side, the former by way of the free end thereof which somewhat projects laterally beyond a clearance 70 of the activator 6 engaging in a clearance, acting as a counter bearing, on the base plate 2.

Transmission means for transmitting a movement from the activator 6 which is linearly moved in the direction P1 to the flap 43 in the case of an activation procedure for unlocking the locking state are provided. The transmission means on the activator 6 have a first transmission portion which comprises an oblique face 68. A further oblique face 69 of the transmission means, which interacts in a planar manner with the oblique face 68, is designed on a part-region of a lower side of the transmission portion 66. The oblique faces 68 and 69 which bear on one another form gear means for transmitting a movement, and in relation to the longitudinal or movement direction of the activator 6, respectively, are inclined by approximately 45 angular degrees in this example. The respective width L3 of the oblique faces 68 and 69 (cf. FIG. 11) is approx. 1 millimeter, for example, having an extent which is transverse thereto of approx. 6 millimeters, for example, this in the direction of the pivot axis D corresponding to the width of the activator 6 in the region of the clearance 70, a very compact construction mode thus being implemented.

The oblique face 68 on the activator 6 is part of a ramp-shaped step which is configured in the clearance 70 on the base of the activator 6. The clearance 70 is configured as a lateral opening, or as a material-free opening which is continuous in the direction of the rotation axis D, respectively, and which extends along approximately half the length of the activator 6. The height of the clearance 70 is adapted such that the transmission portion 66 engages therethrough, or such that the part of the transmission portion 66 having the oblique face 69 is received in a fitting manner, respectively.

The oblique face 68 connects a lower base area 71 in the clearance 70 to an upper base area 72 which in relation to the base area 71 is elevated. The width of the oblique face 68 corresponds to the width of the clearance 70.

The oblique face 69 on the transmission portion 66 of the flap 43 is configured on a pedestal which projects from a semi-circular external side of the transmission portion 66.

Figure 11:
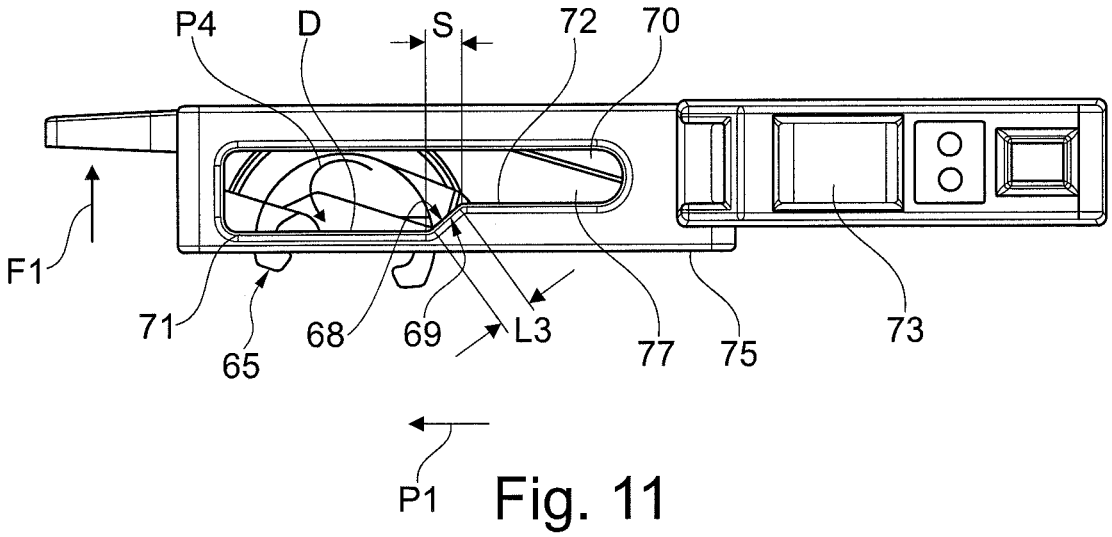
FIG. 11 shows a side view of the assembly according to FIG. 10.

Moreover, the spring 74 which is not illustrated in FIGS. 10 and 11 and which holds the biased activator in the standby position is accommodated in a spring receptacle 73 on the activator 6. When the drawer 53 is depressed in the direction M2 in the case of an activation procedure, the activator 6 by the ejector 5 which bears on the entrainment element 23 is pushed in the direction P1.

The linear displacement movement of the activator 6 from the standby position in the direction P1 by the distance s of, in particular, a few millimeters suffices for the oblique face 68 on the activator 6 to be moved past below the oblique face 69 on the transmission portion 66 such that the flap 43 is pivoted by a few angular degrees in the direction P4 and counter to the force F1 of the leaf spring 49. A pivot angle of approximately 10 angular degrees, for example, is swept by pivoting the flap 43 in the direction P4 about the rotation axis D. This comparatively minor pivoting path suffices for the locking mechanism of the tensioned state of the force accumulator 3 to be cancelled, as has been described above. Herein, the stop face 76 which is aligned so as to be vertical or transverse to the pivoting direction of the guide lever 34, respectively, is moved in an upward manner past the locking element 41 which in a blocked manner bears on the guide lever 34. The blocking effect of the stop face 76 is thus cancelled, and the lever attachment 40 with the locking element 41 pivot past under the appendage 77, or below the flap 43, respectively. By way of the activation procedure, and by pivoting the flap 43 in the direction P4, the appendage 77 is moved in an upward manner so far that the locking element 41 is cleared, or may move into the biased ejector pivoting direction thereof, respectively, and is no longer blocked by the stop face 76.

When the lever attachment 40 has moved past the appendage 77, the flap 43, under the action of the force F1 and by being pivoted in the direction P3, returns to the state according to FIGS. 10 and 11, that is to say to a position in which the flap 43 acts in a locking manner.

By way of the resetting force of the spring 74 the activator 6 by way of being moved in the direction P2 is returned to the initial position thereof.

LIST OF REFERENCE SIGNS

1 Ejector unit
2 Base plate
3 Force accumulator
4 Coupling installation
5 Ejector
6 Activator
7 Locking member
8 Front-gap adjustment assembly
9 Cover component
10 Coil spring
11 Coil spring
12 End
13 Fixed mounting
14 Mounting part
15 Set part
16 Operating portion
17 End
18 Motion element
19 Guide contour
20 Linear guide
21 Contact portion
22 Set screw
23 Entrainment element
24 Latch component
**24*a*** Guide pin
25 Guide track
26 Stop element
27 Guide track
29 Bearing portion
30 Tension lever
31 Mounting pin
32 Retaining member
33 Spring element
34 Guide lever
35 Connection element
36 Mounting pin
37 Mounting pin
38 Mounting pin
39 Mounting pin
40 Lever attachment
41 Locking element
42 Stop element
43 Flap
44 Contact portion
45 Housing
46 Operating portion
47 Wall portion
48 Wall
49 Leaf spring
50 Item of furniture
51 Basic furniture structure
52 Guide means
53 Drawer

54 Drawer base
55 Drawer front
56 Side wall
57 Rear drawer wall
58 Device
59 Basic-structure side wall
60 Leg spring
61 Synchronizer bar
62 Device
63 Linear guide
64 Central portion
65 Receptacle
66 Transmission portion
67 Tongue
68 Oblique face
69 Oblique face
70 Clearance
71 Base area
72 Base area
73 Spring receptacle
74 Spring
75 Lower side
76 Stop face
77 Appendage

The invention claimed is:

1. A device for moving a movable furniture part in an opening direction in relation to a base furniture structure of an item of furniture, wherein the device is configured to movably guide the movable furniture part by way of guide means in the opening direction and in a closing direction, which is counter to the opening direction, wherein the device, which is configured to be fitted to the item of furniture, comprises a force accumulator such that the device is configured to move the movable furniture part under action of the force accumulator in the opening direction of the movable furniture part, wherein the force accumulator is tensioned in a charging procedure and the device comprises a locking assembly having a locking member that has a locking position that locks a tensioned position of the force accumulator, in which the force accumulator is charged for the opening movement of the movable furniture part, wherein the device further comprises an activator element and the tensioned position of the force accumulator is unlocked by displacing the activator element, which interacts with the locking member, wherein the locking member is pivotably mounted so as to rotate in one direction to the locking position or in an other direction, which is opposite to the one direction, via a pivot axis, with the locking member being adjacent to the activator element in a lateral direction, wherein the activator element is coupled to the locking member in such a manner that the activator element has a material-free opening that is directly adjacent to the locking member in the lateral direction, whereby the locking member in the locking position is engaged in the one direction via the pivot axis through the material-free opening in the activator element, and wherein the tensioned position of the force accumulator is unlocked by a linear repositioning movement of the activator element laterally towards the locking member, which engages the locking member such that the locking member is subjected to a pivoting movement in the other direction via the pivot axis, such that the locking member is disengaged from the material-free opening and the locking member is released from the locking position.

2. The device according to claim 1, wherein the activator element is adapted such that the linear repositioning movement of the activator element in relation to a fitted state of the device is performed by way of a movement of the movable furniture part from a closing state of the furniture part that is predefined on the base furniture structure in the closing direction.

3. The device according to claim 1, wherein the activator element and an ejector part, repositionably mounted on the device, of the device are intercoupleable such that in a coupled state the linear repositioning movement of the activator element is performed by a repositioning movement of the ejector part in an activation direction.

4. The device according to claim 1, wherein the locking member and a force-accumulator receptacle on which the force accumulator is received are present so as to be mutually spaced apart, wherein direct bearing contact between the locking member and the force-accumulator receptacle is precluded.

5. The device according to claim 1, wherein the locking assembly has retaining means which automatically urge the locking member in the direction of the locking position.

6. The device according to claim 1, comprising transmission means having a first transmission portion on the activator element, and a second transmission portion on the locking member are provided, wherein the first and second transmission portions contact one another in order for the locking position of the locking member to be released.

7. The device according to claim 6, wherein the first transmission portion and/or the second transmission portion in relation to the direction of the linear repositioning movement of the activator element have an obliquely aligned area portion.

8. The device according to claim 1, wherein the activator element is mounted so as to be sprung.

9. The device according to claim 1, wherein the locking member in the locking position forms a stop for a counter portion which is coupled to the force accumulator, wherein the counter portion contacts the locking member such that a movement of the counter portion is blocked in that direction in which the counter portion moves after the locking member has been released from and returned to the locking position.

10. An item of furniture having a base furniture structure and a movable furniture part which by way of guide means is capable of being put in an opening direction and in a closing direction which is counter to the opening direction relative to the base furniture structure, wherein the device according to claim 1 is provided.

* * * * *